US005238305A

United States Patent [19]

Feller

[11] Patent Number: 5,238,305

[45] Date of Patent: Aug. 24, 1993

[54] COLLAPSIBLE DRIP-DRY ACCESSORY BAG

[76] Inventor: Pamela L. Feller, 4349 Estrella Ave., San Diego, Calif. 92115

[21] Appl. No.: 931,575

[22] Filed: Aug. 13, 1992

[51] Int. Cl.[5] ..... B65D 30/06; B65D 30/22; B65D 33/14; B65D 33/28

[52] U.S. Cl. ..... 383/22; 383/24; 383/39; 383/75; 383/117

[58] Field of Search ..... 383/22, 24, 38, 39, 383/75, 102, 117; 224/209, 253

[56] References Cited

U.S. PATENT DOCUMENTS

| | | | |
|---|---|---|---|
| 1,416,238 | 5/1922 | Seiler | 383/38 |
| 3,749,211 | 7/1973 | Cima | 383/117 X |
| 4,010,785 | 3/1977 | Patik | 383/117 X |
| 4,228,834 | 10/1980 | Desnick | 383/117 X |
| 4,630,312 | 12/1986 | Milstein | 383/102 X |
| 4,925,070 | 5/1990 | Tulgan | 224/209 X |
| 4,940,173 | 7/1990 | Jacober | 224/209 X |
| 4,949,842 | 8/1990 | Mokiao, II | 383/117 X |
| 4,974,761 | 12/1990 | Luque | 224/253 X |
| 5,000,582 | 3/1991 | Pierson | 383/117 X |
| 5,050,998 | 9/1991 | Wachtel | 383/38 X |
| 5,065,864 | 11/1991 | Schmitt | 383/39 X |
| 5,092,682 | 3/1992 | Fenick | 383/22 |
| 5,102,225 | 4/1992 | Hollinger et al. | 383/117 X |

*Primary Examiner*—Gary E. Elkins
*Assistant Examiner*—Jes F. Pascua
*Attorney, Agent, or Firm*—Ralph S. Branscom

[57] ABSTRACT

A collapsible bag of open mesh construction of synthetic cords provides a main, central pocket to hold shampoo and the like, and one or more closeable side pockets. The main pocket has drawstrings to secure the contents, and at the upper edge where the drawstrings close is a loop for hooking the unit on a hook, and also an openenable strap for releasable suspending the bag from a shower curtain or the like, the principle purpose of the accessory bag being to coordinate the accessories that one must temporarily take for use in a shared shower.

1 Claim, 1 Drawing Sheet

COLLAPSIBLE DRIP-DRY ACCESSORY BAG

BACKGROUND OF THE INVENTION

Anyone who has used a semi-public shower such as at a gymnasium, spa, campground, or in a dormitory, could attest to the aggravation of gathering all of the accessories one needs in the shower, using them in the shower, and then getting them back together again to take with them when they leave.

The following items are among those taken into the shower by many people: shampoo (a tall narrow bottle); hair conditioner (a bottle like the shampoo bottle); a tooth brush; tooth paste; dental floss; mouth wash; disposable razors; shaving cream; soap; body lotion; a hair brush, or, any combination of the above. It would be a good guess that the average showerer uses at least half a dozen items in the shower. To get these to the shower and back, various techniques are used. Some people gather them loosely in their arms. Other people bunch them into a towel. Some people put them into a plastic grocery bag. Others may have some kind of special container they have adapted for the purpose.

Once in the shower, a few showers have adequate shelves or a hanging rack to conveniently assemble these accessories. However, much more typically, there is a soap dish, and everything else that cannot be taped, strapped, hung or stapled to the users body must be laid out loosely on the floor of the shower room, with every effort being made to put the stuff where it will not be directly showered upon, or in the case of a completely open shower, stepped on by adjacent fellow showerers.

There is a real need for a convenient and clever specially designed container that compacts into a small space when not in use, and conveniently holds shower items and provides for hanging the container in a shower to avoid the above-recited aggravations.

SUMMARY OF THE INVENTION

The instant invention is an accessory bag that meets the above-stated need. It is made from several overlying panels of net material which are sewn together between border hems to provide a body having a main, central pocket which is deep enough to hold tall bottles such as shampoo and conditioner bottles, with a pair of side pockets designed to hold smaller items.

The top of the body of the unit will cinch completely closed with a drawstring, and it has means to attach the body to a hook, a showerhead, a faucet, a shower rod, or virtually anything that is near the shower.

DETAILED DESCRIPTION OF THE PREFERRED EMBODIMENT

Figure 1:
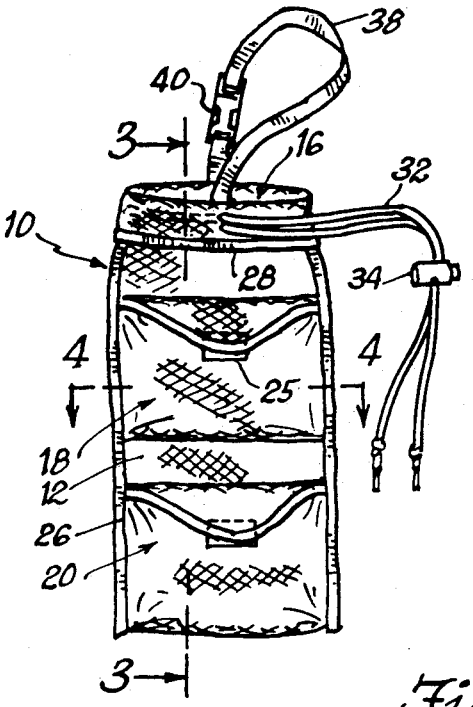
FIG. 1 is a front elevation view of the accessory bag.
Figure 2:
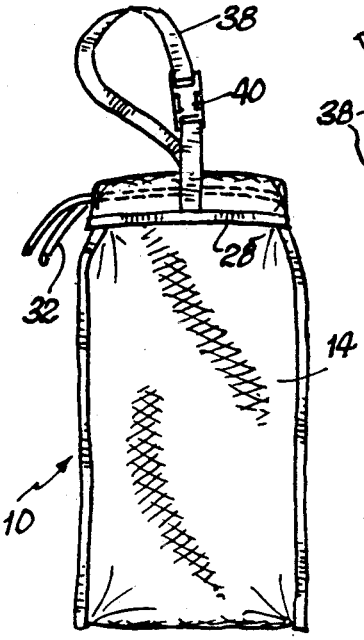
FIG. 2 is a rear elevation view of the accessory bag.

As illustrated in FIG. 1, the accessory bag has a main body portion 10 largely defined from a vertically elongated front panel 12 and a rear panel 14. The front and rear panels could be end portions of a single length of open weave cloth sometimes referred to as open-celled net. These two panels define the main pocket 16 used to hold shampoo and other tall or bulky items.

Figure 3:
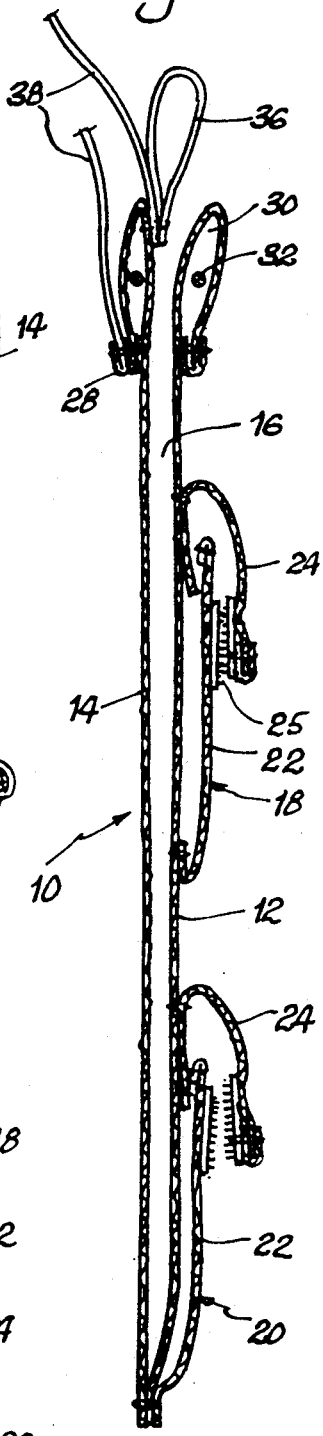
FIG. 3 is a vertical section taken along line 3—3 of FIG. 1.
Figure 4:
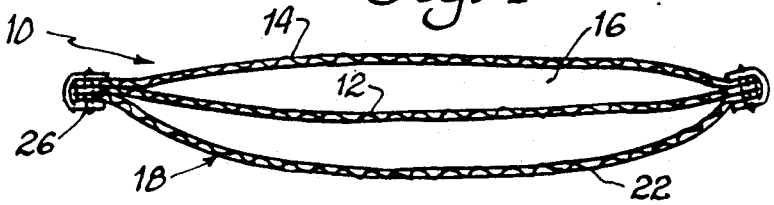
FIG. 4 is a transverse section taken along line 4—4 of FIG. 1.
Figure 5:
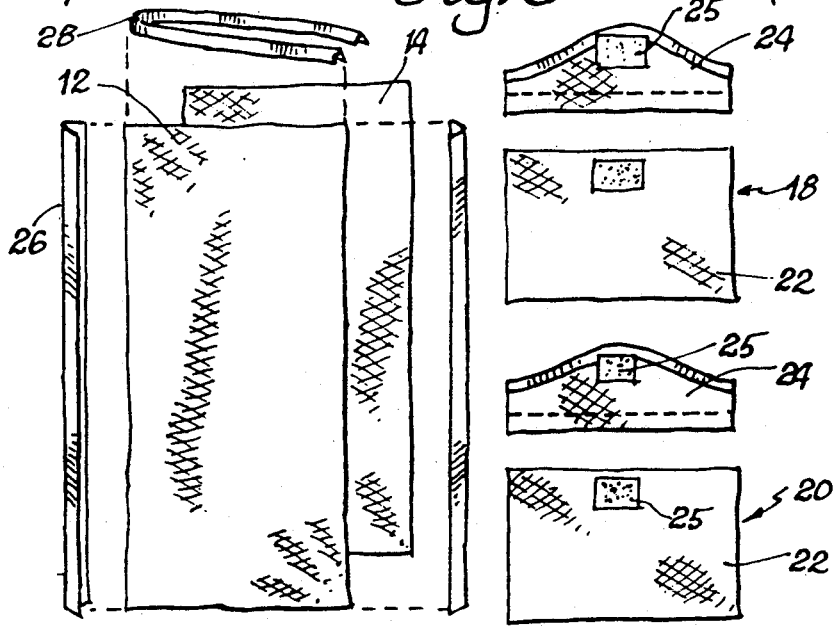
FIG. 5 is a top plan view of the principle parts of the invention as they would be seen prior to the sewing the bag together.

On the front of the main pocket 16 are sewn side pockets 18 and 20. Each of these side pockets has a front panel 22 and a cover 24, there being mating hook-and-loop (Velcro ®) fasteners 25 to hold the covers in place on the front panels. All of the panels and the covers are sewn together between hems 26 which encompasses side pocket side edges 27 to achieve the configuration best illustrated in FIG. 3, with the main pocket and the two side pockets. The top edge of the body is hemmed at 28, with the edges being folded down and stitched to the body of the bag to define a drawstring channel 30. The drawstring 32 passes through the channel 30, and is preferably connected to itself by means of the barrel-type clasp 34 that operates by squeezing the two ends to permit mutual sliding of the drawstrings.

In addition to the above recited structure, the body of the bag requires some type of loop so that it can be hung to projecting structure adjacent to a shower or shower stall. In the preferred embodiment, there are two of these, the first one being a simple, short loop of cloth 36 sewn into the bag and which can be looped around a small hook. The other loop is actually an elongated strap 38 having a release such as the buckle 40, permitting the bag to be hung on shower curtain bars or overhead pipes, et cetera, which are unsuitable for use with the short loop 36. Both of these loops are laterally centered on the body, attached at the intersection of the top edges of the body and the plane of lateral symmetry, which from the front and back amounts to a discernible vertical centerline 37.

One of the important features of the accessory bag disclosed herein lies in the fabric from which the body is made. This fabric is actually a netting material having small hexagonal netted holes having a diameter of about ⅛th of an inch, defined by a high-strength, light-weight, totally synthetic thread which retains very little moisture. When the user is through with the shower and with all of the accessories back in the shower bag, the shower bag can be swung around a couple of times to fling of excess moisture, with little moisture adhering to the slippery bag threads.

Thus the instant invention fulfills a need that has been around for many many years, and despite the inconvenience made obvious by its absence, has not spawned the development of a similar product. This product is ideally suited for the very specific purpose for which it was designed, that is carrying accessories from a sleeping area or another bathroom area into a shower area.

It is hereby claimed:

1. An open-weave accessory bag comprising:

(a) a body having:

(i) a main pocket extending substantially the entire length of said body and having a front panel and a back panel, which panels further comprising side edges, with a discernable vertical centerline, and an open top;

(ii) said boy having a substantially continuous top edge and defining a substantially continuous channel around said top edge and closure means for closing said top comprising a drawstring engaged through said channel;

(iii) a pair of vertically aligned side pockets of substantially identical size defined on the front panel of said main pocket, said side pockets having side edges;

(iv) each of said pockets having closing top flaps mounting hook-and-loop fastener material engageable with mating hook-and-loop fastener material mounted on the respective side pocket said side pockets spanning substantially the entire width of said front panel;

(b) said back panel having a top, and including a loop extending from the top of the back panel of said body at the vertical centerline thereof for hanging said accessory bag from a convenient projection such that it will hang symmetrically left-to-right and will tend to hand forward to expose the contents of said bag when said top is open;

(c) said body and loop being highly flexible in their entirety and substantially completely composed of synthetic fiber material; and, (d) said body being on the order of 15" tall and being composed completely of light-weight, compactible open-celled net hemmed at the seams and including side hems which hem the side edges of said side pockets and the side edges of said front panel together, such that the bag can be rolled or folded when empty into a small space such as a purse or the corner of a gym bag.

* * * * *